United States Patent [19]

Matsumoto et al.

[11] Patent Number: 4,925,538

[45] Date of Patent: May 15, 1990

[54] METHOD OF ELECTROLYTIC TREATMENT OF METALS

[75] Inventors: Yukiei Matsumoto; Yoshinori Nishiki; Kazuhiro Hirao, all of Kanagawa; Takayuki Shimamune, Tokyo, all of Japan

[73] Assignee: Permelec Electrode Ltd., Kanagawa, Japan

[21] Appl. No.: 418,765

[22] Filed: Sep. 5, 1989

Related U.S. Application Data

[63] Continuation of Ser. No. 191,625, May 9, 1988, abandoned.

[30] Foreign Application Priority Data

May 8, 1987 [JP] Japan ..... 62-110455

[51] Int. Cl.[5] ..... B23H 3/00

[52] U.S. Cl. ..... 204/129.4; 204/129.43; 204/140; 204/144.5; 204/290 R

[58] Field of Search ..... 204/129.4, 129.43, 290 R

[56] References Cited

U.S. PATENT DOCUMENTS

| | | | |
|---|---|---|---|
| 3,574,074 | 4/1971 | Khera | 204/128 |
| 4,021,320 | 3/1977 | Moeglich | 204/96 |
| 4,052,271 | 10/1977 | Beer | 204/38 A |
| 4,146,438 | 3/1979 | de Nora | 204/1.5 |
| 4,316,787 | 2/1982 | Themy | 204/242 |
| 4,445,980 | 5/1984 | Smith | 204/15 |
| 4,589,959 | 5/1986 | Nakamatsu | 204/28 |

FOREIGN PATENT DOCUMENTS

| | | |
|---|---|---|
| 0243302 | 10/1987 | European Pat. Off. . |
| 1061295 | 3/1967 | United Kingdom . |
| 1370529 | 10/1974 | United Kingdom . |
| 1392692 | 4/1975 | United Kingdom . |
| 2117407 | 10/1983 | United Kingdom . |

OTHER PUBLICATIONS

Chemical Abstracts, vol. 95, No. 8 (1981), p. 529, Resume No. 69804u (Walaszkowski et al) entitled, "Studies of the Stability of Anodes Working Together with a Pulsed Power Source".

GB Search Report.

*Primary Examiner*—John F. Niebling

*Assistant Examiner*—Isabelle Rodriguez

*Attorney, Agent, or Firm*—Sughrue, Mion, Zinn, Macpeak & Seas

[57] ABSTRACT

A method of electrolytically treating metals with an a.c. current or alternating pulsive current using an electrode comprising a metal substrate having a coating that comprises an oxide of ruthenium, iridium or rhodium as a counter electrode.

4 Claims, No Drawings

METHOD OF ELECTROLYTIC TREATMENT OF METALS

This is a continuation, of application Ser. No., 07/191,625, filed May 9, 1988 abandoned.

FIELD OF THE INVENTION

The present invention relates to a method of electrolytically treating aluminum, stainless steel or other metals using insoluble metal electrodes with an a.c. current or alternating pulsive current being applied.

BACKGROUND OF THE INVENTION

Electrochemical conversion processes applied to metals such as aluminum conventionally involve the etching of metal surfaces as a preliminary treatment. For instance, prior to anodization of aluminum or coloring of stainless steel, etching is performed for various purposes such as the removal of unwanted materials from metal surfaces, activation thereof, and roughening of the same. Etching applied for these purposes is roughly divided into two types, chemical etching involving the immersion of the work in an etchant solution, and electrolytic etching in a bath. Electrolytic etching is conventionally performed with a d.c. current applied to the work serving as an anode, or with an a.c. current or alternating pulsive current being applied to the work. The latter method, referred to as "a.c. etching", is popular today chiefly because it is capable of producing a uniform surface on the work and because it allows for simple post-treatments.

The present invention basically relates to an electrolytic treatment that involves the use of an a.c. current or alternating pulsive current. This method of etching has been performed by various techniques. In electrolytic etching of aluminum, a bath with a pH of 1 to 8 such as aqueous sodium chloride or hydrochloric acid that contains chloride ions is commonly employed and an a.c. or alternating pulsive current is applied at a density of 10 to 100 $A/dm^2$ to a graphite counter electrode. This technique is most common because it enables efficient etching operations. However, the graphite used as a counter electrode is less conductive than metals and in order to permit operations at current densities as high as 10 to 100 $A/dm^2$, the electrode must be made very thick and large and this increases the size of the equipment.

A further problem with graphite is that it is not as convenient to handle as are metals and that it cannot be freely worked into desired shapes. Besides this problem, the graphite electrode is generally porous and either absorbs the liquid electrolyte or undergoes electrolytic reactions in the electrode during service. As a result, it gradually loses its surface shape and is unable to be used consistently for a prolonged period. Furthermore, the need to increase the distance between the electrode and the work results in an increased electrolytic voltage and hence in increased power consumption.

With a view to solving these problems, a method has been proposed that uses an electrode that is made of a valve metal as exemplified by titanium, a corrosion-resistant metal. This method effectively solves the problems with the graphite electrode, such as large size, large work-to-electrode distance and high power consumption. However, the valve metal, as its name implies, provides a valve action by which it forms a passivated film on its surface to retard current flow during anodic polarization and by which it admits free passage of current during cathodic polarization. Because of this "rectifying" action, the electrode cannot be employed in electrolysis with an a.c. current or alternating pulsive current without upsetting the balance between positive and negative polarities to cause adverse effects on the work. Stated more specifically, anodic polarization predominates over cathodic polarization with respect to the work and the waveform of the current applied is also distorted.

In order to solve these problems, an electrolytic treatment that employs a platinum-coated titanium electrode has been proposed. This method ensures a good balance between positive and negative polarities and appears to solve all problems by reducing not only the size of the electrode but also the power consumption. However, platinum is fairly vulnerable to a.c. current or alternating pulsive current and undergoes electrolytic reactions during use. Therefore, if the electrolyte contains chloride ions, chlorine and oxygen will evolve as a result of an anodic reaction and waste gas treatment will be required Furthermore, hydrogen evolving as a result of the cathodic reaction will embrittle the titanium substrate and the life of the electrode is inevitably shortened if the substrate breaks

SUMMARY OF THE INVENTION

The present invention has been accomplished in order to solve the aforementioned problems of the prior art. An object, therefore, of the present invention is to provide an improved method for electrolytic treatment of metals by application of an a.c. current or alternating pulsive current.

This object of the present invention can be attained by a method of electrolytically treating metals with an a.c. current or alternating pulsive current using, as a counter electrode, an electrode comprising a metal substance having a coating that comprises an oxide of ruthenium, iridium or rhodium.

DETAILED DESCRIPTION OF THE INVENTION

The present invention is based on the finding that when a coated insoluble metal electrode having a catalytically active oxide layer that contains an oxide of a platinum group metal such as ruthenium, iridium or rhodium is used as a counter electrode for application of an a.c. current or alternating pulsive current, a current will flow through the counter electrode but the occurrence of electrochemical reactions, such as generation of oxygen or halogen during anodic polarization and hydrogen evolution during cathodic polarization, is substantially absent to ensure that only the work is treated In other words, the counter electrode serves as a capacitor during electrolysis and will not work in any way that severely distorts the waveform of the applied a.c. current or alternating pulses, thereby ensuring that no adverse effects will be exerted on the work.

As described above, the counter electrode of the present invention can be used solely for the purpose of current application and no electrochemical reactions will take place at this electrode. This essentially eliminates the need of waste gas treatments. Since the surface of the electrode is entirely free from products of electrolysis, the distance to the work can be sufficiently reduced to realize a very compact apparatus for electrolysis. In the absence of any electrolytic reaction occurring at the counter electrode, a corrosion-resistant electrode material can be used for an essentially unlimited period Since no gas will evolve at the electrode, the work is free from deposition of gas particles and is amenable to uniform etching over the entire surface, thereby affording the advantage of consistency in the finishing of the work.

In the process of the present invention, a metal substrate having a coating that contains an oxide of a platinum group metal is used as a counter electrode. A suitable platinum group metal is selected from among Ru, Ir and Rh. Platinum is not effective since an oxide form thereof is labile under practical conditions and tends to be reduced to metallic Pt which is a stable form. Paladium has no resistance to corrosion at all under the conditions anticipated for the practice of the present invention. Among the three platinum group metals mentioned above, Ru and Ir are particularly preferred and both are capable of forming stable oxides of the rutile type.

The objective of the present invention can be satisfactorily attained by an electrode having a coating solely made of an oxide of Ru, Ir or Rh. If desired, a more durable and rugged electrode can be made by forming a composite oxide coating with the aid of an additive that produces an oxide having coordination number six, preferably of the rutile type. The type and amount of the additive to be employed for this purpose are not limited in any way but preferred examples are group IV elements of the periodic table such as Sn, Ti, Zr and Hf, or group V elements such as Nb and Ta. All of these elements form oxides of coordination number six. When these elements are thermally fired by ordinary techniques, a rugged coating of rutile type solid solution oxides with Ru or Ir in appearance is produced. The coating on the counter electrode of the present invention preferably contains the oxide of the platinum group metal in an amount of at least 10 wt %, and the balance may be the oxide of the additive.

The electrode of the present invention can be fabricated by any of the known methods and a particularly advantageous method generally referred to as a "pyrolytic process" is described in Japanese Patent Publication No. 3954/73; according to this method, a coating solution containing thermally decomposable salts of the metallic compounds of which the coating is to be made is applied to a metal substrate, which is then heated in an oxidizing atmosphere such as air to pyrolytically form a fired coating on the substrate. While a variety of metals can be used as substrates, in consideration of corrosion resistance and economy, titanium, tungsten and alloys thereof are advantageous. If electrolysis is to be performed in a strongly acidic bath (pH=0 to 4), W or alloys thereof are desirably used as the substrate, and with a broader pH range of 1 to 10, Ti or Ti alloys are desirably used.

In order to perform an electrolytic treatment effectively, the a.c. current or alternating pulsive current to be applied must have a reasonably high frequency. A minimum of 20 Hz is generally required and a desired value is 30 Hz and higher. Therefore, the commercial frequency of 50 Hz or 60 Hz can be employed without any problem at all. If an alternating pulsive current is to be used, the current applied may have any waveform such as a rectangular or triangular shape so long as- the ratio of positive to negative pulses is approximately unity. Suitable current density of the a.c. current or alternating pulsive current ranges from 10 to 200 A/dm$^2$.

After properly selecting the electrode and the a.c. current or alternating pulsive current to be applied, an electrolytic treatment of metals can be performed in a consistent and effective manner by employing conventional liquid electrolytes and conditions of electrolysis.

The following example is provided for the purpose of further illustrating the present invention but is in no way to be taken as limiting.

EXAMPLE

A commercial titanium plate was roughened on one surface by blasting and pickled to provide a substrate. A coating solution was prepared by dissolving Ru and Ta in HCl at a weight ratio of 65:35 (Ru:Ta) and applied to the Ti substrate with a brush. After drying, the coated substrate was heated in a muffle furnace for 15 minutes under circulation of hot air (500° C.). The above procedure was repeated 10 times to make an electrode having a coating of a rutile type Ru-Ta oxide containing Ru in an amount of 10 g/m$^2$.

Using this electrode as a counter electrode, an aluminum plate in a saturated aqueous solution of sodium chloride was treated electrolytically with an a.c. current (50 Hz) being applied at a density of 100 A/dm$^2$. The aqueous sodium chloride solution was held at 90° C.

For comparison purposes, electrolysis was conducted under the same conditions except that a graphite plate, a titanium plate or Pt-plated titanium plate was used as a counter electrode. The liquid electrolyte was circulated after filtration. One piece of the work was subjected to electrolytic treatment for about 10 minutes and the electrolytic operation was continued for 24 hours with the workpiece being successively changed. The results are summarized in Table 1.

TABLE 1

| Counter electrode | State of electrode | State of the work | State of the liquid electrolyte |
|---|---|---|---|
| Ru—Ta oxide/Ti (Sample of the invention) | no gas evolution and stable | uniformly etched | white turbidity due to aluminum hydroxide |
| Graphite | gas evolved and corners of the electrode collapsed | many high and low spots | black turbidity |
| Ti | electrode surface blackened and voltage unstable | unevenly etched | gray turbidity |
| Pt-plated titanium | gas evolved and high initial voltage caused instability | evenly etched | turned yellowish |

As the data in Table 1 show, the method of the present invention enables the workpiece (Al plate) to be uniformly etched without gas generation. When electrolysis was performed with the graphite counter electrode, partial collapse of the electrode occurred. In electrolysis with the titanium counter electrode, a black compound of titanium hydride formed on the electrode surface, which also led to electrode collapse. Whether the graphite or titanium electrode was used, the electrolytic operation was unstable and the workpiece could not be uniformly treated.

When the Pt-plated titanium counter electrode was used, not only did gas evolution occur but also a high initial voltage was observed. Furthermore, the cell voltage increased after a few hours and it was difficult to accomplish stable operations.

In short, the method of the present invention offers the following advantages. Since it employs as a counter electrode a metal substrate having a coating that contains an oxide of Ru, Ir or Rh, metals such as aluminum and stainless steel can be uniformly treated by electrolysis with an a.c. current or alternating pulsive current in a consistent manner for a prolonged period without involving gas evolution. In addition, the substantial absence of electrolytic reactions occurring at the counter electrode eliminates the need for waste gas treatment. Finally, the distance between the electrode and the workpiece can be sufficiently shortened to reduce not only power consumption but also the size of the equipment.

While the invention has been described in detail and with reference to specific embodiments thereof, it will be apparent to one skilled in the art that various changes and modifications can be made therein without departing from the spirit and scope thereof.

What is claimed is:

1. A method of electrolytically etching aluminum or stainless steel, the method consisting of passing an a.c. current or alternating pulsive current through an electrolytic cell containing said metal to be etched as an electrode and an electrode comprising a metal substrate having a coating comprising an oxide of ruthenium, iridium or rhodium as a counter electrode.

2. A method according to claim 1 wherein the a.c. current or alternating pulsive current has a frequency of at least 20 Hz.

3. A method according to claim 1 wherein the a.c. current or alternating pulsive current is applied at a current density of 10 to 200 $A/dm^2$.

4. A method according to claim 1 wherein the metal substrate of said counter electrode is made of titanium, tungsten or an alloy thereof.

* * * * *